United States Patent [19]

Abe

[11] Patent Number: 4,714,408

[45] Date of Patent: Dec. 22, 1987

[54] RADIATOR FAN

[75] Inventor: Takeshi Abe, Kawasaki, Japan

[73] Assignee: Nissan Motor Co., Ltd., Yokohama, Japan

[21] Appl. No.: 870,961

[22] Filed: Jun. 5, 1986

[30] Foreign Application Priority Data

Jun. 6, 1985 [JP] Japan ..... 60-121415

[51] Int. Cl.[4] ..... F04D 29/38

[52] U.S. Cl. ..... 416/91; 416/231 R

[58] Field of Search ..... 416/91, 231 R

[56] References Cited

U.S. PATENT DOCUMENTS

| | | | |
|---|---|---|---|
| 218,438 | 8/1879 | Heath | 416/231 |
| 241,124 | 5/1881 | Deane | 416/231 |
| 1,038,317 | 9/1912 | Donner | 416/231 B |
| 1,066,988 | 7/1913 | Boutwell | 416/231 |
| 1,717,745 | 6/1929 | Tismer | 416/231 X |
| 1,890,120 | 12/1932 | Klinger | 416/231 |
| 1,961,114 | 5/1934 | Tully et al. | 416/91 |
| 2,003,073 | 5/1935 | Faber | 416/231 |
| 2,340,417 | 2/1944 | Ellett | 416/231 |
| 3,044,559 | 7/1962 | Chajmik | 416/231 X |

FOREIGN PATENT DOCUMENTS

| | | | |
|---|---|---|---|
| 118769 | 8/1944 | Australia | 416/91 |
| 2507562 | 12/1982 | France | 416/231 R |
| 51-123905 | 10/1976 | Japan . | |
| 54-32809 | 3/1979 | Japan . | |
| 88902 | 7/1981 | Japan | 416/91 |
| 186099 | 11/1982 | Japan | 416/231 R |
| 39593 | 3/1983 | Japan | 416/231 R |
| 12794 | of 1910 | United Kingdom | 416/231 B |
| 244385 | 12/1925 | United Kingdom | 416/91 |
| 754055 | 8/1956 | United Kingdom | 416/231 |
| 568748 | 8/1977 | U.S.S.R. | 416/231 R |

*Primary Examiner*—Everette A. Powell, Jr.

*Attorney, Agent, or Firm*—Schwartz, Jeffery, Schwaab, Mack, Blumenthal & Evans

[57] ABSTRACT

A radiator fan is disclosed which comprises a plurality of blades, each having formed therethrough a number of passages each of which extends in such a direction as not to be influenced by dynamic pressure which the blade is subject to.

6 Claims, 6 Drawing Figures

RADIATOR FAN

BACKGROUND OF THE INVENTION

The present invention relates to a radiator fan and more particularly to an automobile radiator fan.

Conventionally, a radiator fan makes a high frequency noise at high speed rotations because of eddies generated near the trailing edge of each of blades.

An object of the present invention is to provide a radiator fan which does not make a high frequency noise at high speed rotations.

SUMMARY OF THE INVENTION

The present invention provides an improved radiator fan comprising:

a plurality of blades adapted to rotate about an axis in a predetermined direction and extending radially outwardly from said axis, each having a leading edge and a trailing edge, each of said blades being contoured to provide a first surface extending from said leading edge to said trailing edge, and a second surface extending from said leading edge to said trailing edge, each of said blades causing a longer line of flow generated along said first surface than a line of flow generated along said second surface when said radiator fan rotates through fluid about said axis in said predetermined direction;

each of said blades having formed therethrough a number of passages, each having a fluid flow inlet opening disposed in said second surface and a fluid flow outlet opening disposed in said first surface, said fluid flow outlet openings being located within at least an area portion of said first surface near the radially outermost of each of said blades.

DESCRIPTION OF THE EMBODIMENTS

Figure 1:
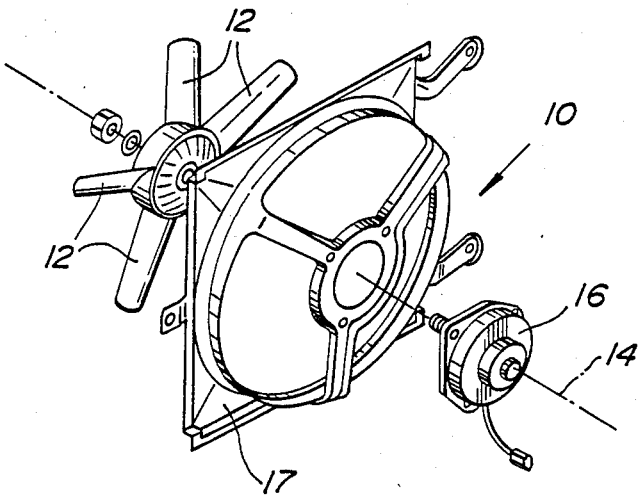
FIG. 1 is a perspective exploded view of a radiator fan.
Figure 2:
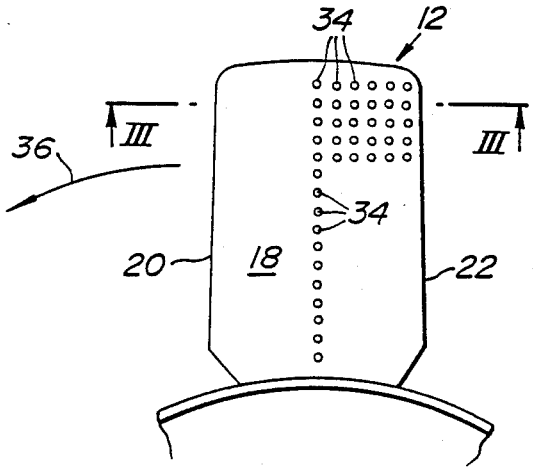
FIG. 2 is a diagrammatic view of a blade of the radiator fan showing one embodiment according to the present invention.
Figure 3:
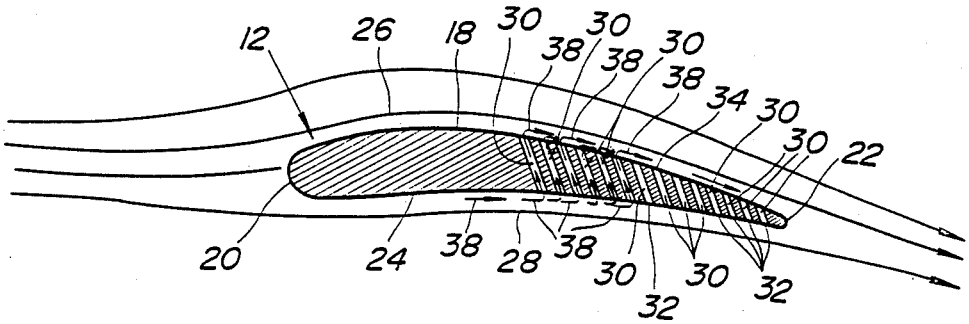
FIG. 3 is an enlarged sectional view taken along III—III of FIG. 2.

Referring to FIG. 1, an automobile radiator fan 10 comprises a plurality of blades 12 which is adapted to rotate in a predetermined direction about an axis 14 and extending radially outwardly from the axis 14. The assembly of blades 12 is driven to rotate about the axis 14 by a motor 16 mounted to a fan shroud 17. Referring also to FIGS. 2 and 3, each of the blades 12 is contoured to provide a first surface 18 extending from its leading edge 20 to its trailing edge 22 and a second surface 24 extending from the leading edge 20 to the trailing edge 22. The terms "leading" and "trailing" are used herein with reference to the direction of rotation of the blade 12. As shown diagrammatically in FIG. 3, when the radiator fan 10 rotates through air, the blade 12 causes a longer line of flow 26 to be generated along the first surface 18 than a line of flow 28 generated along the second surface 24. To suppress generation of eddies, each blade 12 has formed therethrough a number of air passages 30, each passage having a fluid flow inlet opening 32 disposed in the second surface 24 and a fluid flow outlet opening 34 disposed in the first surface 18. As best seen in FIG. 2, the outlet openings 34 are located within at least an area portion of the first surface 18 near the radially outermost of the blade 12. This area portion is considered to be an area where eddies are likely to be generated. There are a column of inlet openings 32 running along the middle line of the width of each blade 12 and five rows of outlet openings 32, each running from the column toward the trailing edge 22, are formed as viewed in FIG. 2. The outlet openings 34 of the column are spaced one after another by 5 mm and the outlet openings 34 in each of the rows are spaced one after another by 5 mm. Each outlet opening 34 is 1 mm in diameter in this embodiment though it may range 0.01 mm to 3.00 mm in diameter, and preferrably from 0.01 mm to 1.50 mm in diameter. The width of each blade 12 is 80 mm in this embodiment. In FIG. 2, the direction of rotation of the blade 12 is designated by an arrow 36. The inlet openings 32 are similarly arranged and dimensioned.

Referring back to FIG. 3, each of the air passages 30 extends from the fluid inlet opening 32 in such a direction as not to be influenced by dynamic pressure which the second surface 24 is subject to when the blade 12 is disposed within the moving air. Specifically, the inlet openings 32 are so oriented as not to allow entrance of air thereinto unless eddies are generated near the first surface 18. When the radiator fan 10 rotates at a high speed, eddies are likely to be generated on the first surface 18 of the blade 12 within an area disposed near the radially outwardmost between the middle line and the trailing edge 22. Since there occurs a drop in pressure within the area where the eddies are generated, air is allowed to flow from the second surface to the first surface through some of the air passages 30 as shown in small arrows 38 in FIG. 3, causing the eddies to disappear.

Figure 4:
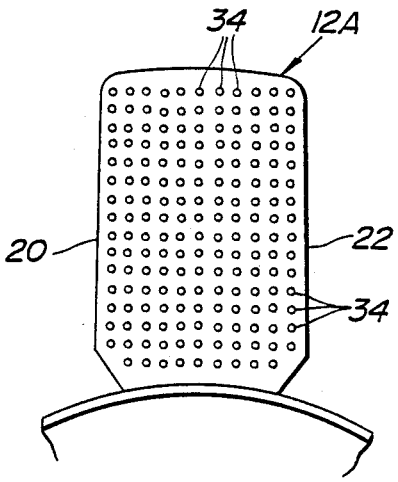
FIG. 4 is a similar view to FIG. 2 showing a second embodiment.
Figure 5:
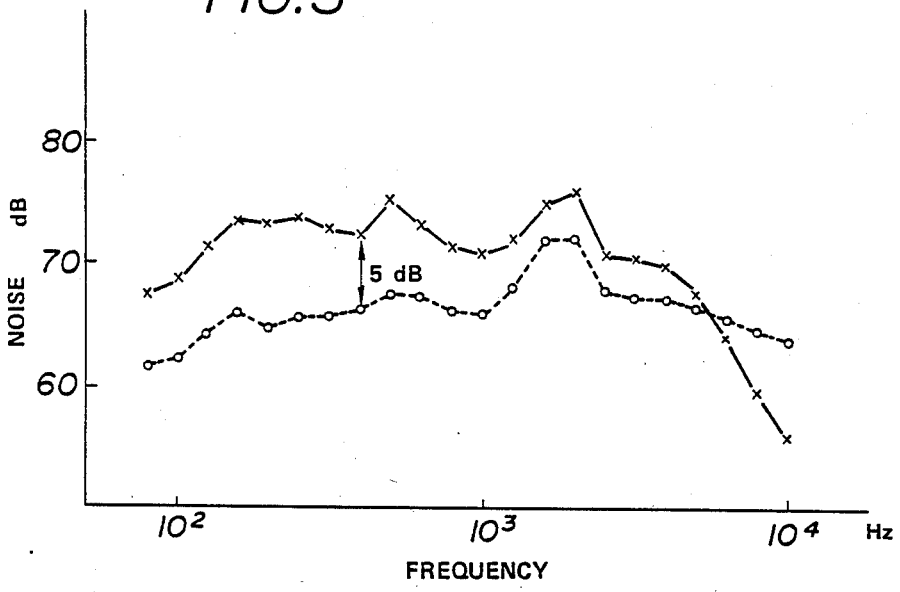
FIG. 5 shows experimental results obtained after measurment of noise level of the second embodiment in comparison with the conventional fan, the measurement being effected at a location downstream of the device.
Figure 6:
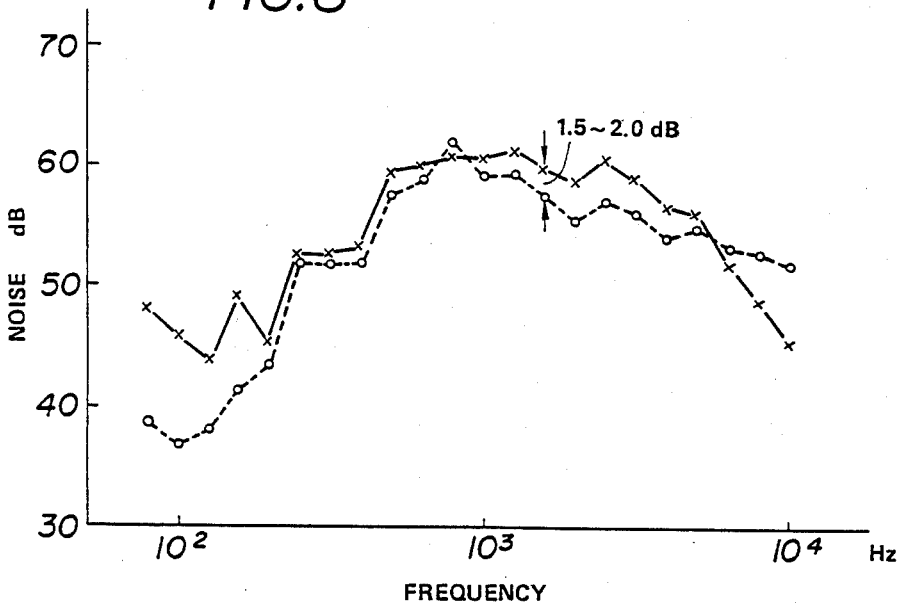
FIG. 6 shows experimental results plotted, the measurement being effected at a location upstream of the fan.

FIG. 4 shows the second embodiment which is different from the first embodiment in that outlet openings 34 of air passages are disposed over the whole area of a first surface of each blade which is now designated by 12A. In order to confirm the effect of provision of air passages 30, noise level is measured at a location downstream of the radiator fan shown in FIG. 1 installed with blades 12A in comparison with the radiator fan shown in FIG. 1 with conventional blades having no air passages formed therethrough. The measurements were carried out at speed of rotation of 2,000 rpm. The results are plotted in FIG. 5 wherein the results obtained by the invention are shown by the sign o and the results obtained by the conventional device are shown by the sign x. The same measurements were carried out at a location upstream of the radiator fan. The results are shown in FIG. 6. As will be appreciated from FIGS. 5 and 6, the invention has provided a drop in noise level as large as 5 dB at the location downstream of the fan and a drop as large as 1.5 dB to 2 dB at the location upstream of the fan as compared to the conventional fan.

What is claimed is:

1. A radiator fan comprising:

a plurality of blades adapted to rotate about an axis in a predetermined direction and extending radially outwardly from said axis, each having a leading edge and a trailing edge, each of said blades being contoured to provide a first surface extending from said leading edge to said trailing edge, and a second surface extending from said leading edge to said trailing edge, each of said blades causing a longer line of flow generated along said first surface than a line of flow generated along said second surface when said radiator fan rotates through fluid about said axis in said predetermined direction;

each of said blades having formed therethrough a number of passages, each having a fluid flow inlet opening disposed in said second surface and a fluid flow outlet opening being located within at least an area portion of said first surface bounded by a radially outermost edge of each of said blades;

wherein each of said number of passages extends from said fluid inlet opening to said fluid outlet opening in a predetermined direction which forms a predetermined acute angle with a direction of rotation of said blade, in order to allow the entrance of fluid into each passage when eddies are formed on said first surface of said blades.

2. A radiator fan as claimed in claim 1, wherein said area portion where said fluid flow outlet openings are disposed is bounded at one end by said trailing edge.

3. A radiator fan as claimed in claim 1, wherein the total number of said fluid flow outlet openings within an area bounded by the radially outermost edge of each of said blades is larger than the total number of said fluid flow outlet openings within an area bounded by a radially innermost edge of each of said blades.

4. A radiator fan as claimed in claim 1, wherein each of said fluid outlet openings has a diameter ranging from 0.01 mm to 3.00 mm.

5. A radiator fan as claimed in claim 1, wherein each of said fluid outlet openings has a diameter ranging from 0.01 mm to 1.5 mm.

6. A radiator fan comprising:

means for pushing fluid in a predetermined direction comprising: an axis, a plurality of blades extending radially outward from said axis, said blades being adapted to rotate about said axis in a predetermined direction, each of said blades having a leading and trailing edge, wherein each of said blades includes a first and a second surface each extending from said leading edge to said trailing edge, and wherein said blades are positioned so as to cause a longer line of fluid flow along said first surface when said radiator fan rotates in said predetermined direction;

means for suppressing the effects of eddies by selectively diverting fluid from said second surface to said first surface in response to formation of eddies on said first surface, said suppressing means comprising a number of passages each extending from a fluid flow inlet opening disposed in said second surface to a fluid flow outlet opening disposed in said first surface, said passages forming a predetermined acute angle with said predetermined rotation direction sufficient to permit passage of fluid through said passages only in response to formation of eddies on said first surface; and wherein said suppressing means is at least located within an area portion bounded by a radially outermost edge of said blades.

* * * * *